US010674848B2

(12) United States Patent
Feeley et al.

(10) Patent No.: US 10,674,848 B2
(45) Date of Patent: Jun. 9, 2020

(54) SILICONE CUP WITH METAL RING AND OPENINGS FOR INSERTING METAL RING

(71) Applicant: Silikids, Inc., Traverse City, MI (US)

(72) Inventors: Anastacia Feeley, Traverse City, MI (US); Giuliana Schwab, Studio City, CA (US)

(73) Assignee: GoSili, Inc., Traverse City, MI (US)

( * ) Notice: Subject to any disclaimer, the term of this patent is extended or adjusted under 35 U.S.C. 154(b) by 307 days.

(21) Appl. No.: 15/451,397

(22) Filed: Mar. 6, 2017

(65) Prior Publication Data

US 2017/0253363 A1 Sep. 7, 2017

Related U.S. Application Data

(60) Provisional application No. 62/304,137, filed on Mar. 4, 2016, provisional application No. 62/346,754, filed on Jun. 7, 2016.

(51) Int. Cl.

| | |
|---|---|
| ***A47G 19/22*** | (2006.01) |
| ***A47G 19/02*** | (2006.01) |
| ***A45F 3/20*** | (2006.01) |

(52) U.S. Cl.

CPC ..... *A47G 19/2272* (2013.01); *A45F 3/20* (2013.01); *A47G 19/02* (2013.01); *A47G 19/2261* (2013.01); *A47G 2400/08* (2013.01); *A47G 2400/10* (2013.01)

(58) Field of Classification Search

CPC ..... A47G 19/2272; A47G 2019/2277; A47G 2400/10; A45F 3/20; A45F 2003/205; B65D 53/02; B65D 1/0292

USPC ..... 220/574

See application file for complete search history.

(56) References Cited

U.S. PATENT DOCUMENTS

| | | | | |
|---|---|---|---|---|
| 5,641,065 | A * | 6/1997 | Owens | B65D 45/20 206/363 |
| 10,196,169 | B2 * | 2/2019 | Tsui | A45C 7/0031 |
| 2016/0309930 | A1 * | 10/2016 | Stewart | A47G 21/18 |
| 2016/0368664 | A1 * | 12/2016 | Balmes | A45F 3/20 |
| 2017/0318994 | A1 * | 11/2017 | Knoblauch | A47G 19/2266 |

* cited by examiner

*Primary Examiner* — Shawn M Braden

(74) *Attorney, Agent, or Firm* — Richards Patent Law P.C.

(57) ABSTRACT

A container comprising a body having an annular side wall on a base, an internal channel within the side wall, and a metal ring disposed within the channel. The container is a flexible material.

17 Claims, 17 Drawing Sheets

SILICONE CUP WITH METAL RING AND OPENINGS FOR INSERTING METAL RING

CROSS-REFERENCE TO RELATED APPLICATIONS

This application incorporates by reference and claims the benefit of priority to U.S. Provisional Application No. 62/304,137 filed on Mar. 4, 2016 and U.S. Provisional Application No. 62/346,754 filed on Jun. 7, 2016, the entireties of which are incorporated herein by reference.

BACKGROUND OF THE INVENTION

The present subject matter relates generally to a silicone container. More specifically, the present invention relates to a silicone container, such as a cup, including a metal element or ring incorporated within the rim, or lip, of the cup to preserve the shape and structural integrity of the cup when squeezed.

Cups and other dishware benefit from certain qualities that are not always present in traditional dishware. Primary among these attributes are durability, portability, and being microwave and dishwasher safe. Further, the ideal dishware avoids other problems with plastic or disposable options, such as the presence of harmful toxins or a damaging environmental impact. However, none of the traditional options for these items addresses the necessary features of cups and dishware while avoiding the pitfalls. The drawbacks for users extend over a wide variety of circumstances, from people on-the-go looking for portability, to outdoor settings where breakage may be particularly hazardous, to child uses of dishware and cups.

For coffee and tea drinkers, portability is essential for taking their morning pick-me-up from home to commute to work. However, coffee vessels are some of the most inconvenient for users. Metal vessels are not microwave or dishwasher safe, while ceramic or glass cups are too heavy and breakable. Plastic and paper solutions raise concerns about toxins and environmental impact. Further, non-rigid models do not hold lids well because of the potential for a lid to pop off when the rim of the cup is squeezed or otherwise deformed.

Parents of small children have several challenges when it comes to providing safe and effective dishware to their children. They require solutions that are unbreakable, spill-proof, and portable. Another challenge to providing dishware is the safety and environmental impact of the product. In the past, dishes such as cups were primarily made of breakable materials, such as glass or ceramics. Because of the potential for breakage, cups made of these materials are not always suitable for small children. A child may be more susceptible to breaking the cup and would be at risk of injury if exposed to broken pieces of glass or ceramic.

Over time, people turned to plastic cups in order to lessen the possibility of breakage. However, recent research has shown that plastic may contain certain toxic chemicals, such as BPA, which may leach from plastic tableware and into the tableware's contents. Even low doses of these chemicals have been linked to the altering of genes in the human body, which can then lead to health risks such as diabetes, autism, heart disease, altered immune system, and early puberty. Further, studies have shown that other chemicals being used in the place of BPA, such as BPS, are just as harmful. These risks are not an issue with traditional breakable materials such as glass or ceramics, or with the less traditional material of silicone.

For parents who do not want to trust their children with breakable cups and have concerns about toxins in plastic, paper and disposable cups are an imperfect solution. Not only does the requirement of continually buying paper goods become costly, but the waste involved gives pause to people who are concerned about the environment.

One solution for both kid-friendly and adult containers is to provide silicone products to eliminate toxins and breakability. However, another challenge is making the container spill proof. Silicone materials may be too flexible for providing the stability to prevent spilling and/or support the securement of a lid or top to the cup. Making the silicone thick enough to not bend would lead to an inefficient use of space and materials, excess weight, and excess cost.

The challenges in providing safe, break-proof tableware are not a coffee-drinker or child-specific problem. In some poolside settings, glass containers are forbidden for safety reasons. Glass also lacks portability because of its weight and the potential for breakage in transit. This makes glass unsuitable for outdoor use. The health and environmental drawbacks of plastic persist no matter who the user is and in which context the use occurs.

The challenges described above primarily with reference to cups are also applicable to a wide range of tableware. For example, cups, bowls, and other containers with and without lids are subject the limitations presented above.

Accordingly, there is a need for an improved silicone container with better structural integrity that can also support the use of a lid or top, as described herein.

BRIEF SUMMARY OF THE INVENTION

To meet the needs described above and others, the present disclosure provides a container, such as a silicone cup or bowl, with a metal element incorporated in the lip or rim to retain the shape of the container.

In one embodiment, the present subject matter provides a cup with a molded body formed of resilient silicone. The cup is configured in a conical shape with a narrower bottom, a wider top, and a lipped rim. The lip or rim of the cup includes a metal element embedded in the silicone. In one example, the bottom of the cup is thicker than the walls of the cup to provide additional strength and stability. In a preferred embodiment, the metal element is a metal ring having a circular cross section. The reinforced rim and the thicker base help to provide stability and prevent the cup from collapsing when squeezed by a user. Additionally, the structural integrity of the rim provides a stable platform to support a lid or top.

In a preferred embodiment, the rim of the cup includes a metal ring suspended within the silicone. The metal ring is encapsulated within the rim during the compression molding of the silicone cup. To properly hold the position of the ring within the rim during the molding process, an anchor or other fixture mechanism may be used to hold the ring in place while the cup, specifically the rim, is formed around it. Depending on the configuration of the anchor, this anchoring process may leave holes or slits in the rim of the cup. In a preferred example, the molded cup may include four holes or slits in the rim of the cup corresponding to the anchoring points provided by the fixture mechanism.

In a further embodiment, the lip includes an internal channel and four openings through which the metal ring is inserted and secured within the channel. The metal ring may be segmented in two or more pieces to make it easier to insert the metal ring into the channel. In other embodiments, the cup may include fewer than or greater than four openings to insert the metal ring. These openings may have varying widths. The base of the cup may be of such a thickness that the bottom of the cup may not be folded in on itself.

In other embodiments, the manufacturing process may include injection molding to form the cup, and the ring may be inserted through holes in the rim or it may be incorporated into the mold with the silicone cup being formed around it.

When in use, the metal ring in the lip and the thick, inflexible bottom component combine to achieve stability in the hands of the user holding the cup. When squeezed, the cup will not lose its shape.

The thick base of the cup may include a recessed annular portion to reduce weight and material used. In preferred embodiments, the recessed portion is designed to remove weight and waste without substantially impacting the structural stability of the cup. In one example, the recessed annular portion allows the base to retain its thickness while eliminating waste and cutting back on weight.

The walls of the cup itself may be thin enough to provide a lightweight and efficient solution, but thick enough to complement the strength of the base and metal ring, delivering a three-component solution for stability. Although the walls may give slightly when squeezed horizontally, the metal ring allows the rim of the cup to retain its shape. The structural stability of the base of the cup and rim prevent the cup from collapsing vertically.

In a preferred embodiment, the diameter of the thickness of the metal ring is 3 mm. In another embodiment, the diameter of the thickness of the metal ring is between and including 2 mm to 4 mm. In a preferred embodiment, the height of the cup is 90 mm, the outer diameter of the lip is 89 mm, the external thickness of the lip is 7.8 mm, the sidewall is 4 mm thick, and the base is 9.8 mm. In another embodiment, the base is between and including 8 mm to 12 mm. Each of these dimensions may be modified as desired or as necessitated by manufacturing limitations.

The cup may come in a variety of colors and it may feature translucent silicone to reveal the metal ring for easy identification.

The cup may include additional features to enhance the functionality of the cup such as a bumpy surface texture for gripping. Additionally, the metal ring in the rim of the cup may provide a rigid shape for mating with cork-like or other press-fit lids. Because the metal ring allows the rim to retain its shape, cork-like lids may be inserted into the cup and anchored under the rigidity of the metal ring. The cup may also be used in connection with flexible lids, including lids with openings for straws, sippy cup tops, sports tops, and coffee lids.

Although this specification is directed to a cup, the principles behind the invention—namely the combination of a thick base, metal ring in the rim, and walls strong enough to draw on the support of the base and ring while remaining thin and lightweight—may be applied to a variety of silicone vessels. Still further, the container may comprise a bowl with a molded body formed of resilient silicone. The bowl includes a lip with an embedded metal ring to provide the structural integrity for supporting a lid.

In one embodiment, a container includes: a body formed from a flexible material, the body including an annular side wall formed integrally with a base; an internal channel within the side wall; and a metal element disposed within the channel.

In some examples, the annular side wall includes a rim located along a top of the side wall and the internal channel is formed within the rim.

In some examples, the rim includes a lip extending outwardly from a centerline of the body.

In some examples, the thickness of the is greater than the thickness of the sidewall.

In some examples, the rim, or the lip, includes a plurality of openings in communication with the channel.

In some examples the metal element is segmented in a plurality of pieces, in other examples the metal element is a unitary ring.

In some examples, the metal element is a metal ring having a circular cross section between about 2 mm and about 4 mm in diameter.

In some examples, the flexible material is silicone.

In some examples, the container also includes a lid mated with the body.

In some examples, the lid is a flexible surface that surrounds an upper portion of the body.

In some examples, the lid press fits into a rim located along a top of the annular side wall.

In some examples, the container is a cup. In other examples, the container is a bowl.

An object of the invention is to provide a silicone cup that will not lose its form when held and is sufficiently rigid at the rim to support a lid or a top.

An object of the invention is to provide a solution to cups that prevents breakage without using potentially hazardous materials such as plastic.

An advantage of the invention is that it is easy to use.

Another advantage of the invention is that it may come in a number of colors and patterns to accommodate the user's dishware preferences.

A further advantage of the invention is that it allows small children to safely use cups.

Yet another advantage of the invention is that it is easy to manufacture.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

Figure 1:
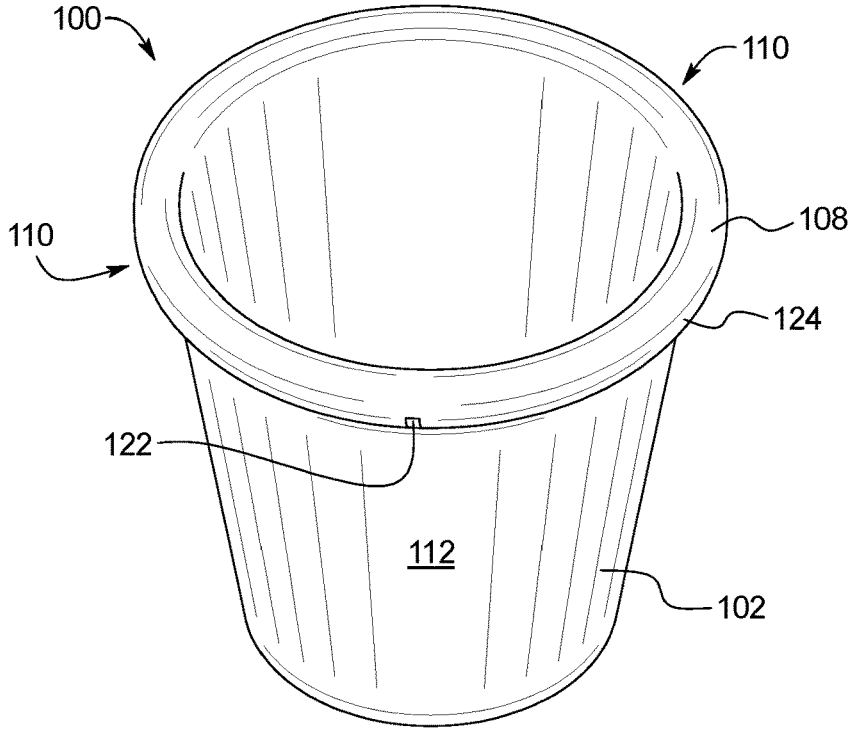
FIGS. 1 and 2 are perspective view from above and from below, respectively, of the cup of the present application.

It should be noted that various changes and modifications to the presently preferred embodiments described herein will be apparent to those skilled in the art. Such changes and modifications may be made without departing from the spirit and scope of the present invention and without diminishing its attendant advantages.

DETAILED DESCRIPTION OF THE INVENTION

FIGS. 1-6 illustrate an example of cup 100 of the present application comprising a body 102 of a silicone material. The cup 100 includes a metal ring 104 embedded within an internal channel 106 of a lip 108 to provide structural support at an upper end 110 of the cup 100.

Figure 2:
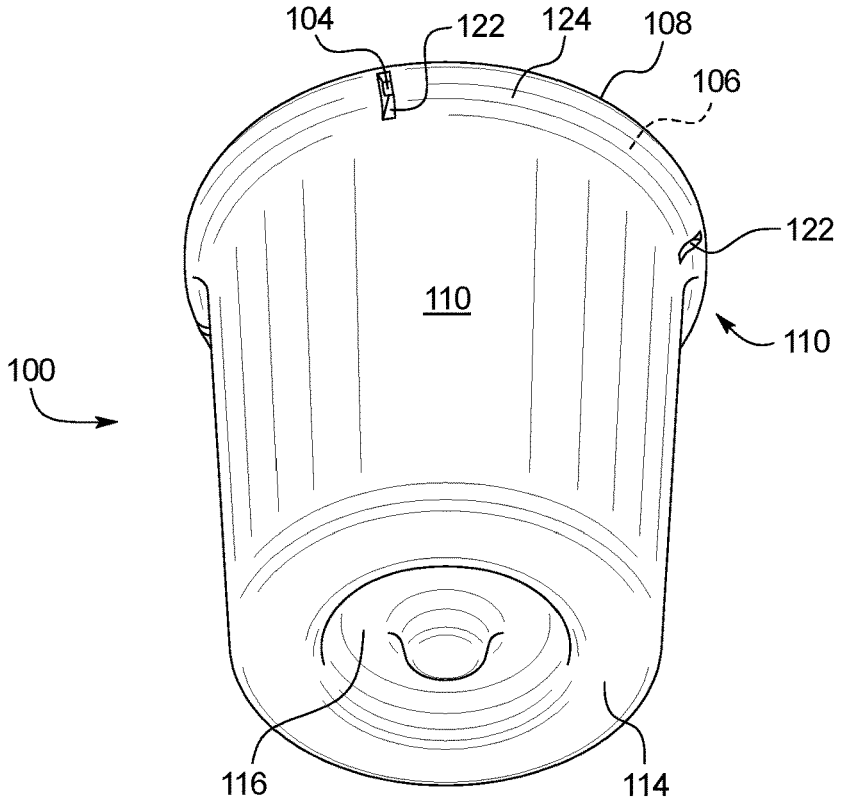

As shown in FIGS. 1 and 2, the body 102 includes an annular side wall 112 that is integral with or attached to a base 114. Seen best in FIG. 4, the cup 100 has a conical shape having a first diameter D1 near the lip 108 that is greater than a second diameter D2 near the base 114. Further, seen best in FIG. 6, a thickness of the annular wall 112 is less than a thickness of the base 114 of the cup 100. In the embodiment illustrated in FIG. 2, the base 114 includes a recessed annular surface 116 that provides additional structural support. Each of the embedding of the metal ring 104 within the lip 108 of the cup 100 and the increased thickness of the base 114 of the cup 100 increases the stability of the cup 100 and collectively prevents the cup 100 from collapsing when squeezed by a user.

Referring again to FIGS. 1 and 2, the metal ring 104 is embedded within the channel 106 of the lip 108 to retain the shape of the cup 100. Shown in FIG. 6, the lip 118 extends annularly away from a central axis 120 of the body 102.

In a preferred embodiment, the metal ring 104 is encapsulated within the rim 108 during the compression molding of the silicone cup 100. During the molding process, an anchor or other fixture mechanism may temporarily be used to hold the metal ring 104 in place while the cup 100, specifically the rim 108, is formed around the metal ring 104. Depending on the configuration of the anchor, this anchoring process may leave one or more openings or slits in the rim 108 of the cup 100. In a preferred example, the molded cup 100 may include four openings or slits in the rim 108 of the cup 100 corresponding to the anchoring points provided by the fixture mechanism.

In a further embodiment, a plurality of openings 122 extends from an outer surface 124 of the lip 108 into the channel 106 for insertion of the metal ring 104 into the channel 106. The metal ring 104 may be segmented in two or more pieces to make it easier to insert the metal ring 104 into the channel 106.

Figure 3:
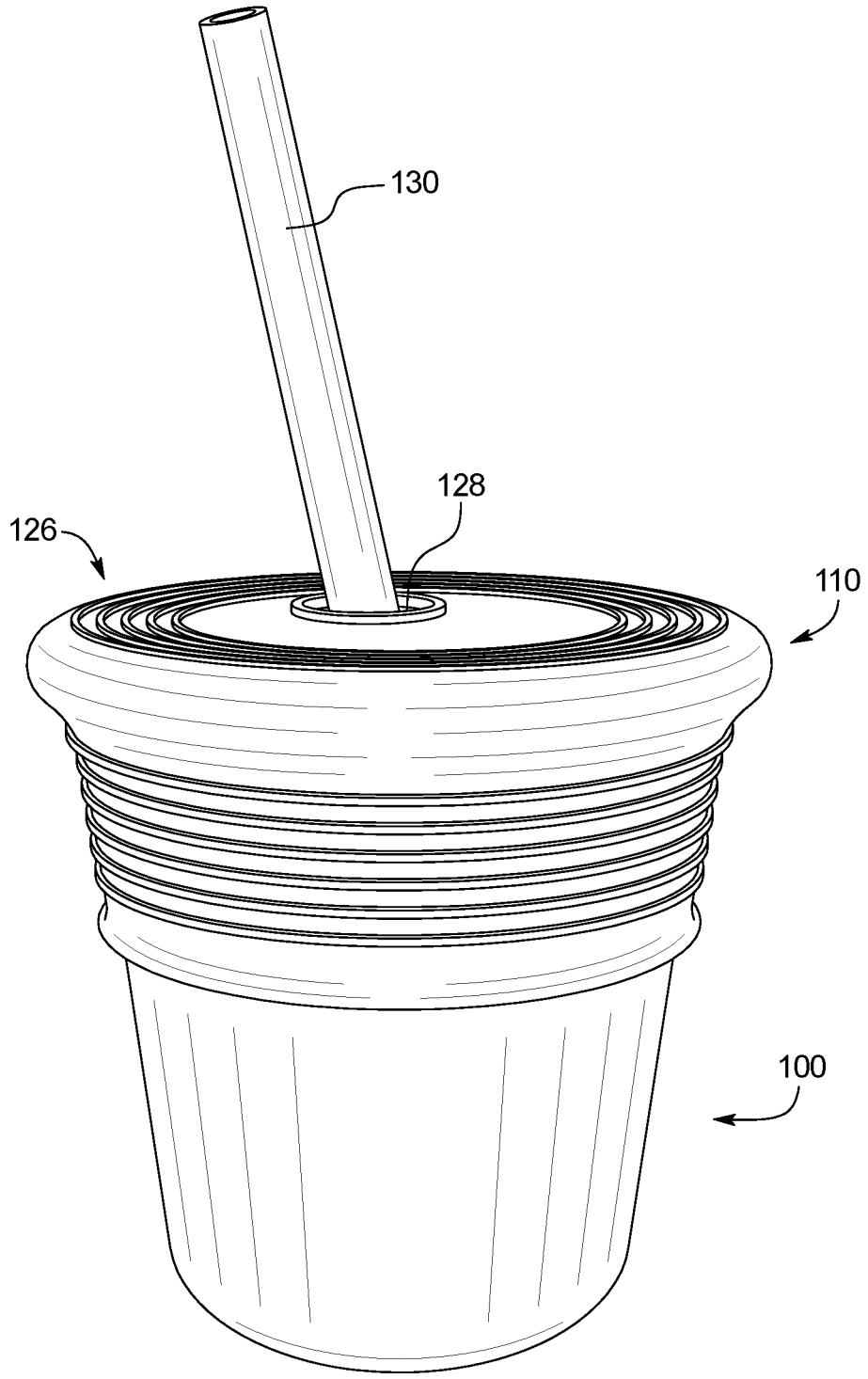
FIG. 3 is a perspective view of the cup of FIG. 1 with a first embodiment of a lid.

As shown in FIGS. 3A and 3B, a removable lid 126, 130 may be secured to the upper end 110 of the cup 100. The metal ring 104 within the lip 108 provides the structural integrity to support the lid 126 attached to the upper end 110 of the cup 100. The lid 1126 illustrated in FIG. 3 is a straw top lid, comprising a silicone or other stretchable material that stretches across the lip 108 of the cup 100 and down a portion of the annular side wall 112. The lid 126 includes an opening 128 for receiving a straw 130. Other lids such as a conventional press fit lid with a straw or other mouthpiece may also be used with the cup 100. As shown in FIG. 3B, a press fit lid 130 may be received along and secured to the inner surface of the lip 108 of the cup 100. The lid 130 includes an internal cork component for mating with the rigid rim 108 of the cup 100.

Figure 4:
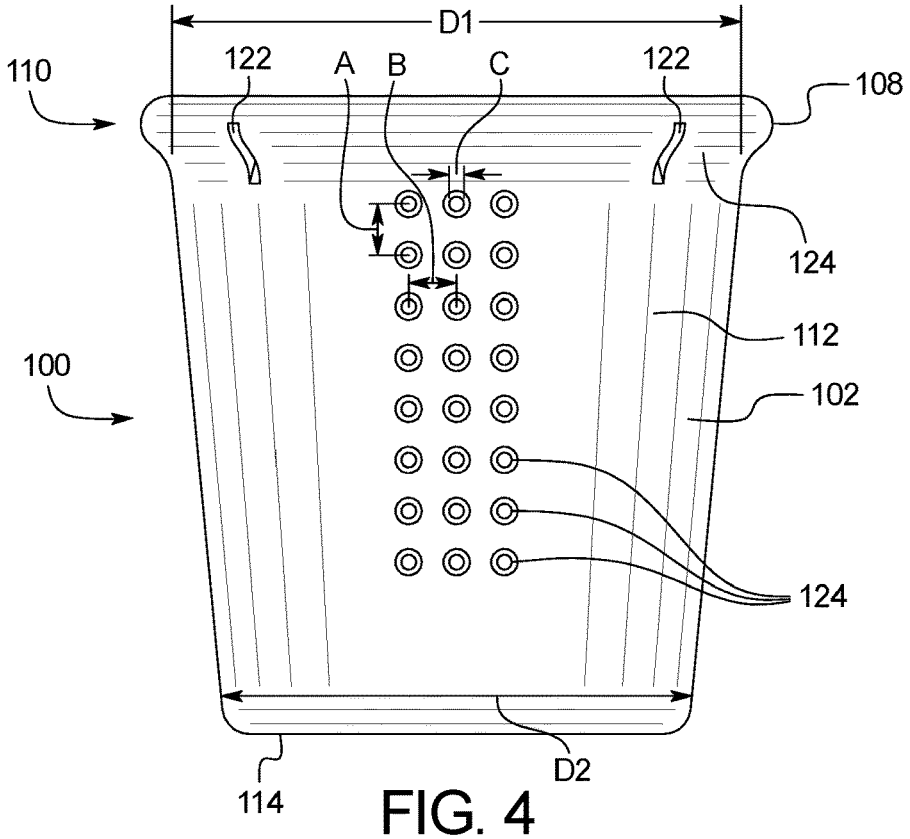
FIGS. 4 and 5 are side elevational and bottom plan views of the cup of FIG. 1 including exemplary dimensions of the cup.
Figure 5:
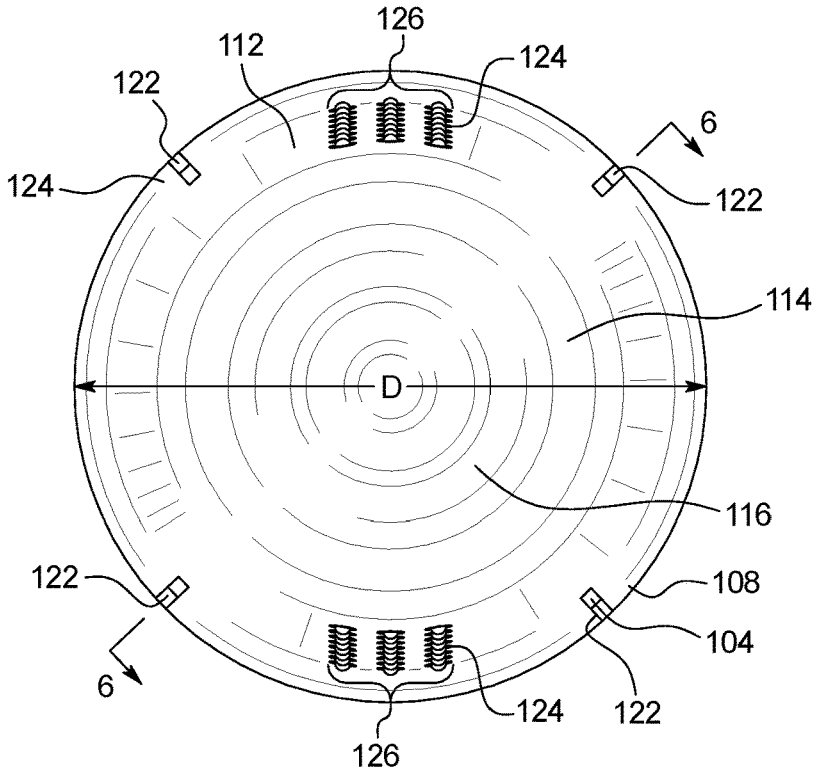

Referring to FIGS. 4 and 5, the cup 100 may include a plurality of protrusions 124 or other raised surface extending outwardly from the side wall 112 in order to improve the user's grip on the cup 100. In the illustrated embodiment, the cup 100 includes first and second groupings 126 of protrusions 124, although the number and spacing of the protrusions 124 may be varied as desired or necessitated by design requirements.

Figure 6:
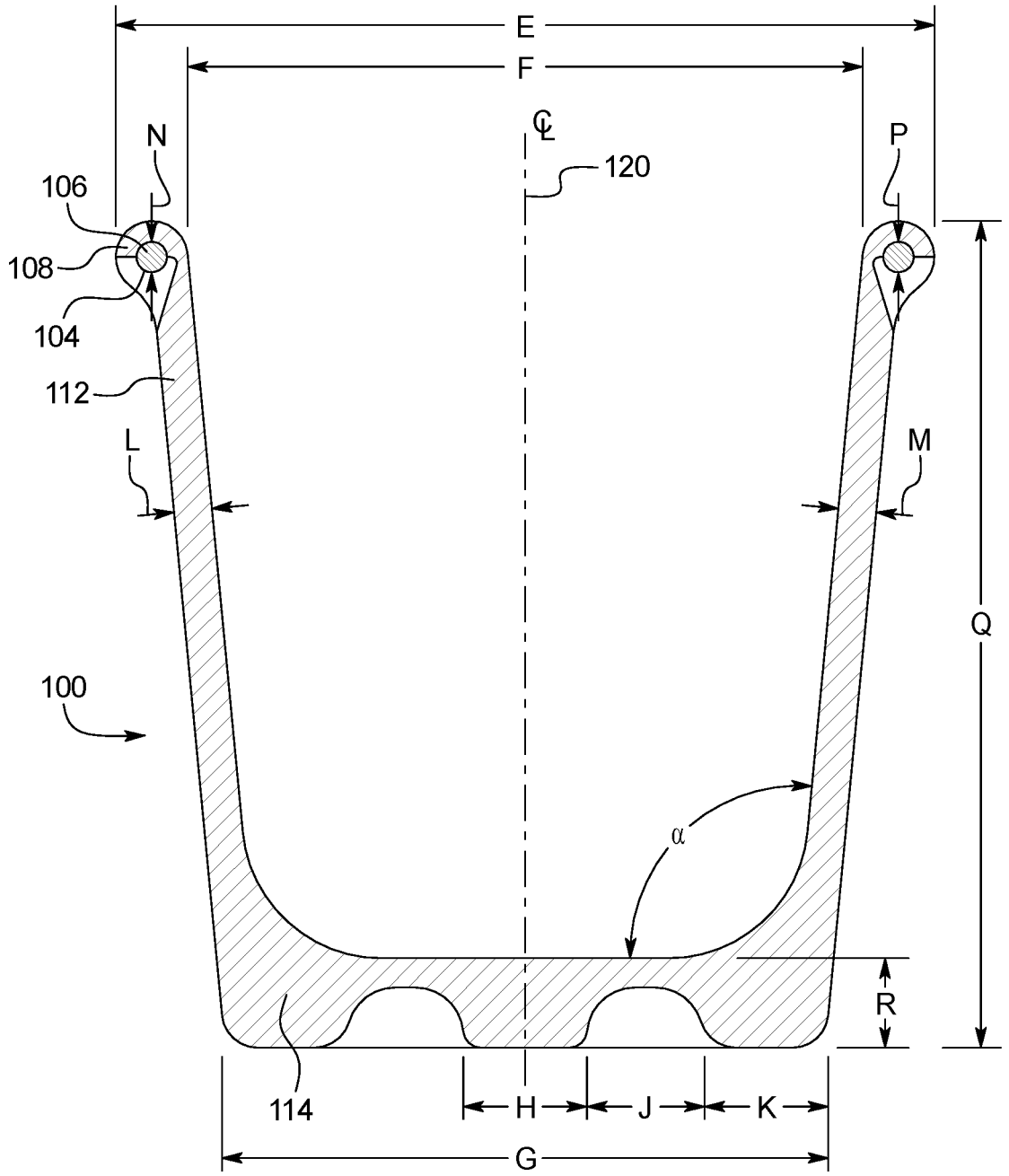
FIG. 6 is a cross sectional view of the cup of FIG. 1 generally taken along lines 6-6 of FIG. 5 including exemplary dimensions of the cup.
Figure 7:
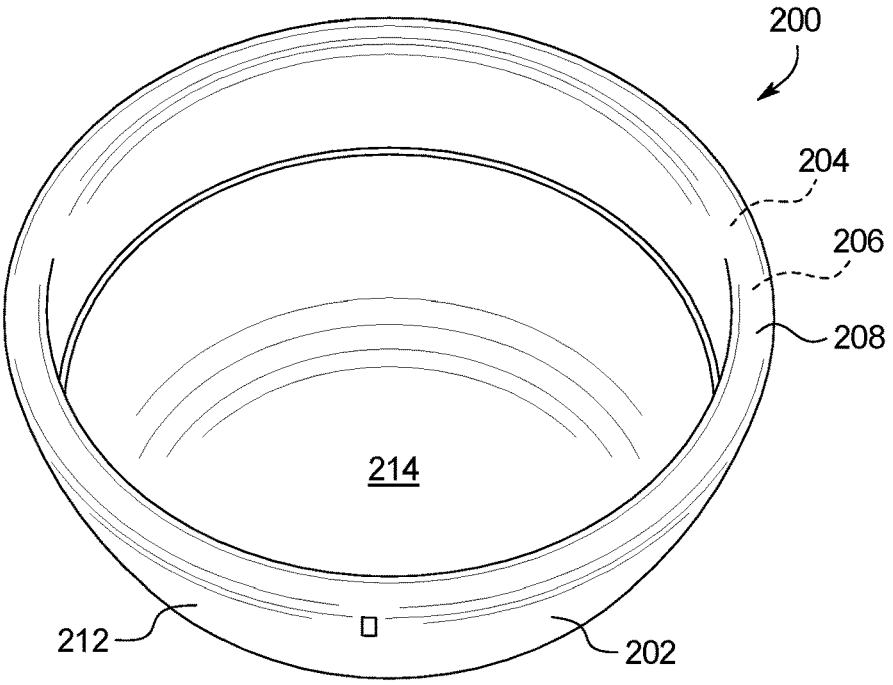
FIG. 7 is a perspective view from above of a bowl of the present application.
Figure 8:
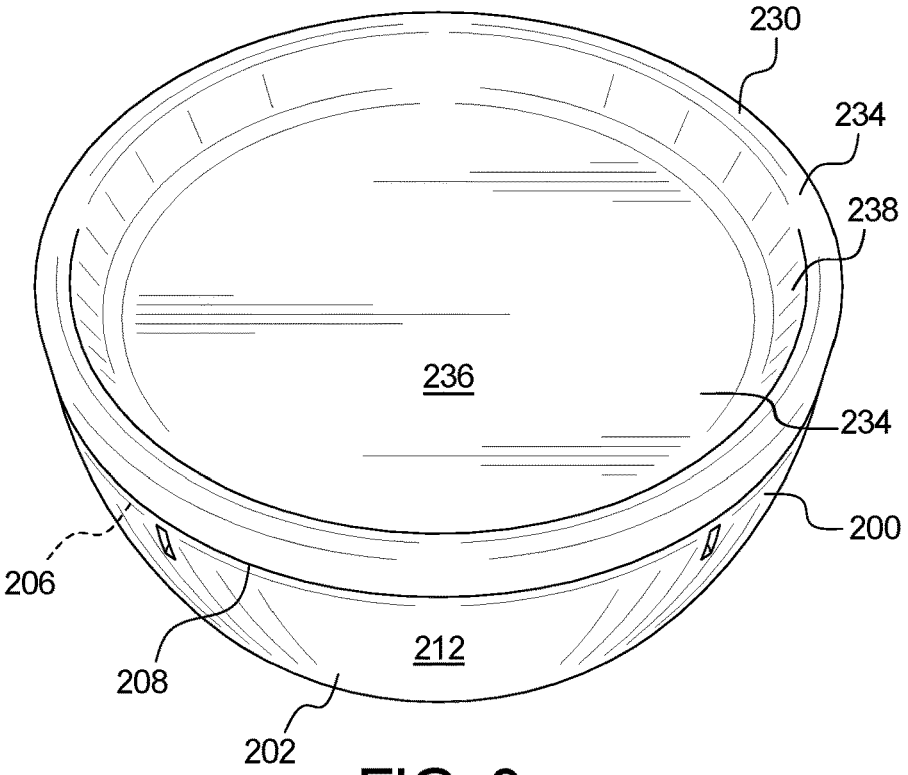
FIGS. 8 and 9 are perspective and side elevational views of a bowl of FIG. 7 with a lid.

In a preferred embodiment illustrated in FIG. 6, the metal ring 104 has a circular cross section with a diameter of about 3 mm. In another embodiment, the diameter of the circular cross section of the metal ring 104 is between and including 2 mm to 4 mm. In a preferred embodiment, the height of the cup 100 is 90 mm, the outer diameter of the lip 108 is 89 mm, the external thickness of the lip 108 is 7.8 mm, the side wall 112 is 4 mm thick, and the base 114 is 9.8 mm. In another embodiment, the base is between and including 8 mm to 12 mm.

In the illustrated embodiment shown in FIGS. 4-6, the illustrated cup has the dimensions recited in the following table, it being understood that the dimensions are exemplary only and do not limit the scope of any claims herein, except as may be recited thereby, together with equivalents thereof:

TABLE 1

Dimensions for FIGS. 4-6

| | Dimensions (mm, unless otherwise specified) |
|---|---|
| FIG. 4 | |
| A | 7 |
| B | 6.8 |
| C | 2.5 |
| FIG. 5 | |
| D | 89.1 |
| FIG. 6 | |
| E | 89 |

TABLE 1-continued

| Dimensions for FIGS. 4-6 | |
|---|---|
| | Dimensions (mm, unless otherwise specified) |
| F | 73.6 |
| G | 66 |
| H | 13.3 |
| J | 12.5 |
| K | 13.8 |
| L | 4 |
| M | 4 |
| N | 7.8 |
| P | 3 |
| Q | 90 |
| R | 9.8 |
| α | 96 degrees |

FIGS. 7-10 illustrate a bowl 200 of the present application comprising a body 202 of a silicone material having a concave shape with an open top. In the illustrated embodiment, the body 202 includes curved, annular side wall 212 that is integral with or attached to a base 214. A rim 208 has an internal channel and a metal ring 204 embedded within an internal channel 206 to provide structural support at an upper end 210 of the bowl 200. In the illustrated embodiment, the rim 208 is an upper surface of the side wall 212 and does not include a lipped surface.

Figure 9:
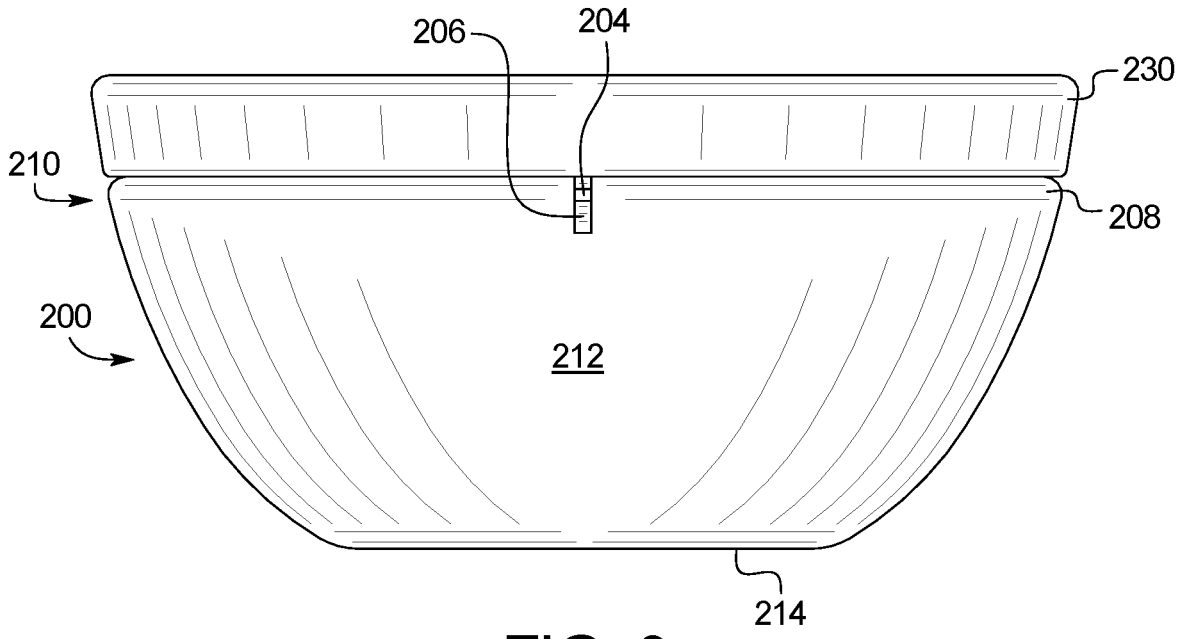
Figure 10:
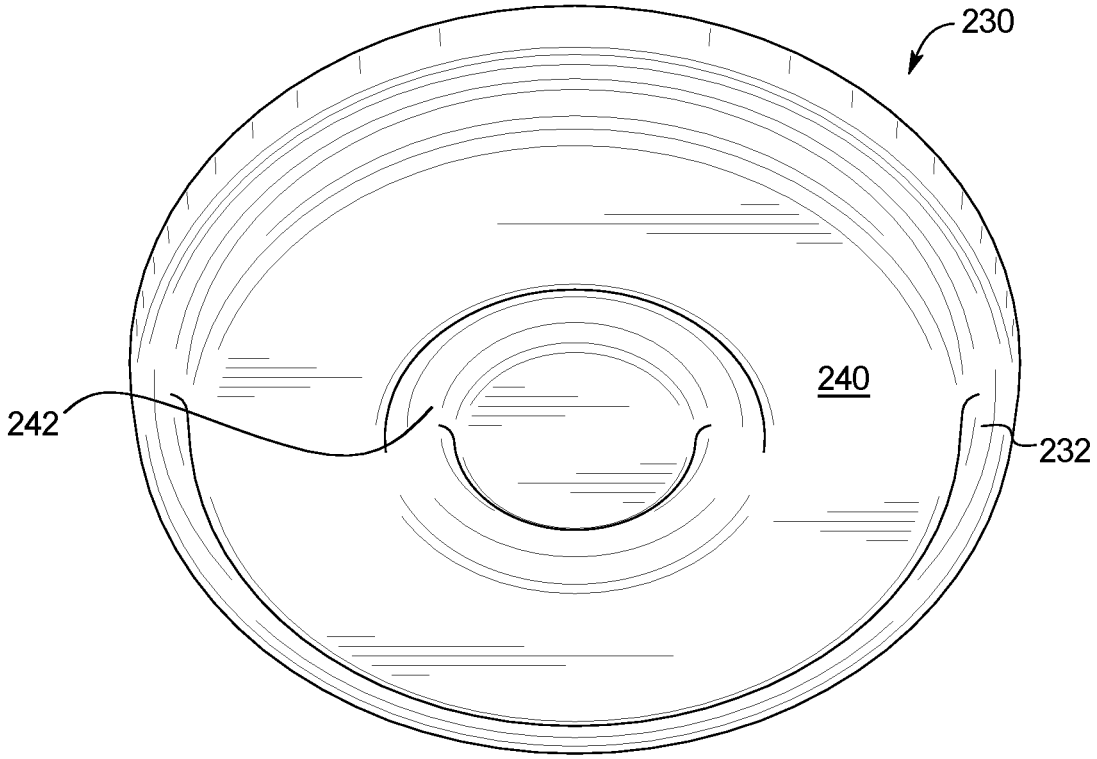
FIG. 10 is a perspective view from below of the lid of FIG. 8.

A lid 230 may be press fit into the inner surface of the rim 208. Seen best in FIGS. 8 and 10, the lid 230 includes an inner portion 232 protruding downwardly from an upper surface 234. The inner portion 232 press fits into the rim 208 so that the upper surface 234 of the lid 230 rests atop the rim 208 of the bowl 200 as shown in FIG. 9. An upper surface 236 of the inner portion 232 is spaced from the upper surface 234 by a side wall 238 that nests within the upper portion 210 of the cup 200. The diameter of the side wall is slightly larger than the diameter of the inner surface of the rim so that the lid 230 press fits into the cup 200. The embodiment of the lid 230 illustrated in FIG. 10 includes a recessed surface 242 on a lower surface 240 of the inner portion 232, although the lower surface 240 may be planar or varying in height. In the illustrated embodiment, the bowl 200 can hold 8 oz, although the design can be scaled for greater or lesser volumes.

In the embodiment shown in FIGS. 11-13, the illustrated bowl has the dimensions recited in the following table, it being understood that the dimensions are exemplary only and do not limit the scope of any claims herein, except as may be recited thereby, together with equivalents thereof:

TABLE 2

Figure 11:
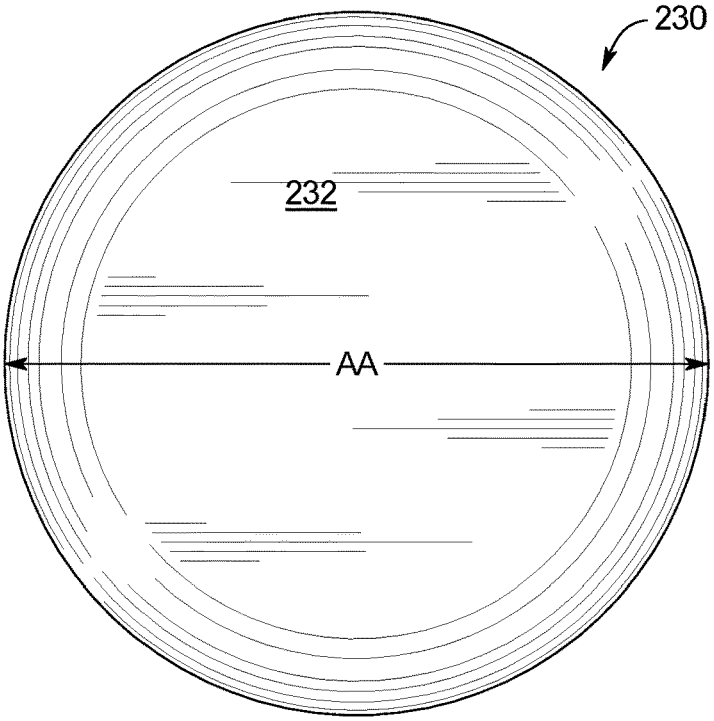
FIGS. 11 and 12 are plan and bottom plan views of the bowl and lid of FIG. 8.
Figure 12:
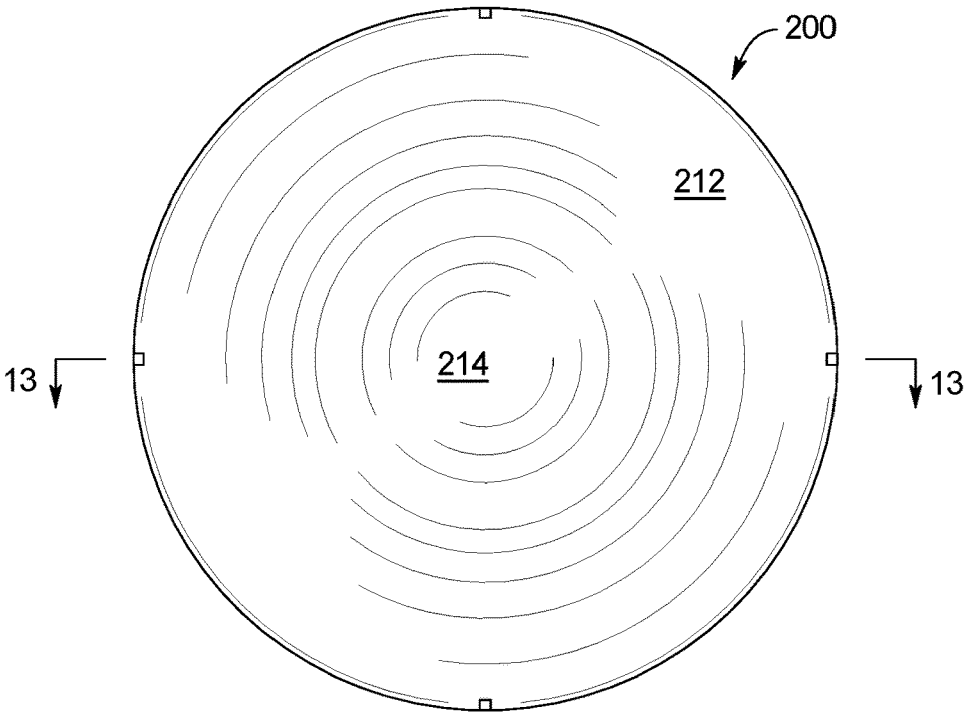
Figure 13:
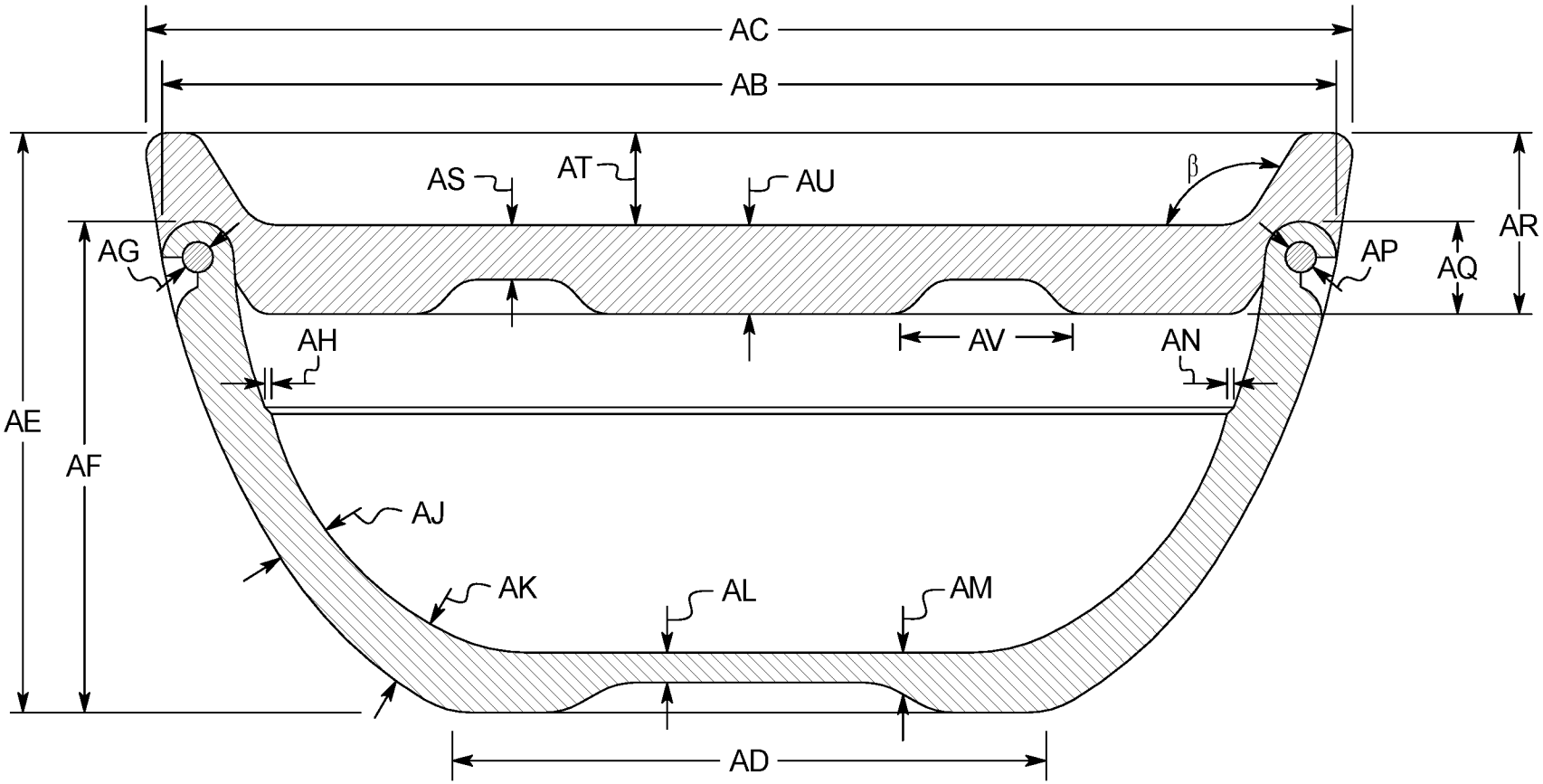
FIG. 13 is a cross sectional view generally taken along lines 13-13 of FIG. 12 including exemplary dimensions of the bowl and lid.
Figure 14:
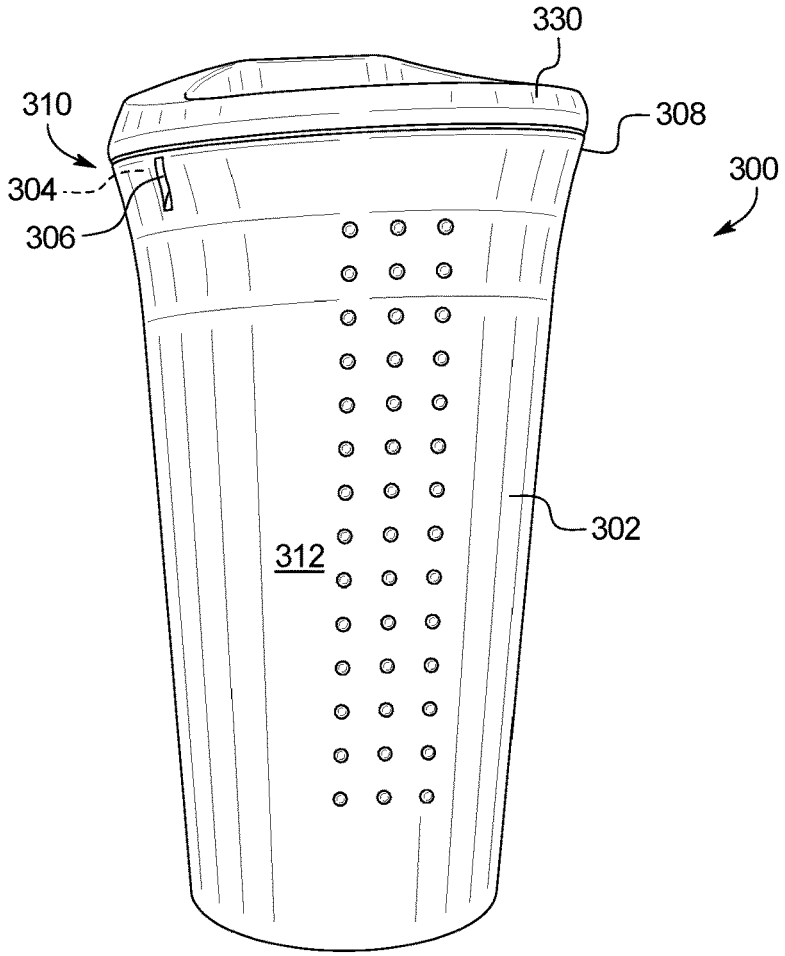
FIG. 14 is a perspective view of a travel coffee cup and lid in accordance with the present application.

| Dimensions for FIGS. 11 and 13 | |
|---|---|
| | Dimensions (mm, unless otherwise specified) |
| FIG. 11 | |
| AA | 118 |
| FIG. 13 | |
| AB | 118 |
| AC | 115 |
| AD | 57 |
| AE | 56.6 |
| AF | 48 |
| AG | 7 |
| AH | 0.8 |

TABLE 2-continued

| Dimensions for FIGS. 11 and 13 | |
|---|---|
| | Dimensions (mm, unless otherwise specified) |
| AJ | 5 |
| AK | 7 |
| AL | 3 |
| AM | 5.8 |
| AN | 0.8 |
| AP | 3 |
| AQ | 8.9 |
| AR | 17.5 |
| AS | 3.3 |
| AT | 9 |
| AU | 8.5 |
| AV | 15 |
| β | 123 degrees |

Referring to FIGS. 14-19, a travel coffee cup 300 comprises a body 302 of a silicone material having an annular side wall 312 formed integrally with a base 314. A lipped rim 308 includes a metal ring 304 embedded within an internal channel 306 to provide structural support at an upper end 310 of the cup 300.

Figure 15:
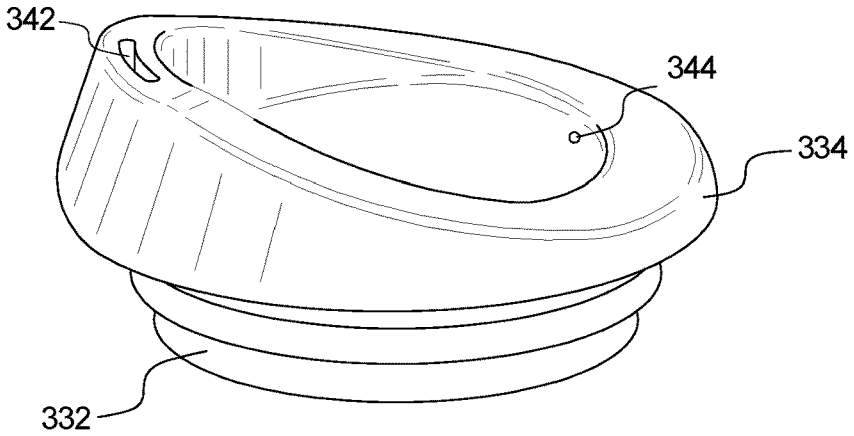
FIG. 15 is a perspective view of the lid of FIG. 14.

A lid 330 may be press fit into an inner surface 341 of the rim 308. Referring to FIG. 15, the lid 330 includes a top portion 334 with a downwardly extending annular wall 332. The annular wall 332 press fits inside the rim 308 so that the top portion 334 of the lid 330 rests atop the rim 308 of the cup 300. An outer surface 336 of the annular wall 332 includes one or more ribs 338 that are received by one or more grooves 340 within an inner surface 341 of the annular side wall 312. The top portion 334 also includes a spout 342 for drinking and a port 344 for relieving pressure within the cup 300 during use. In the illustrated embodiment, the cup 300 can hold 16 oz, although the design can be scaled for greater or lesser volumes.

In the illustrated embodiment shown in FIGS. 16-19, the illustrated coffee cup has the dimensions recited in the following table, it being understood that the dimensions are exemplary only and do not limit the scope of any claims herein, except as may be recited thereby, together with equivalents thereof:

TABLE 3

Figure 16:
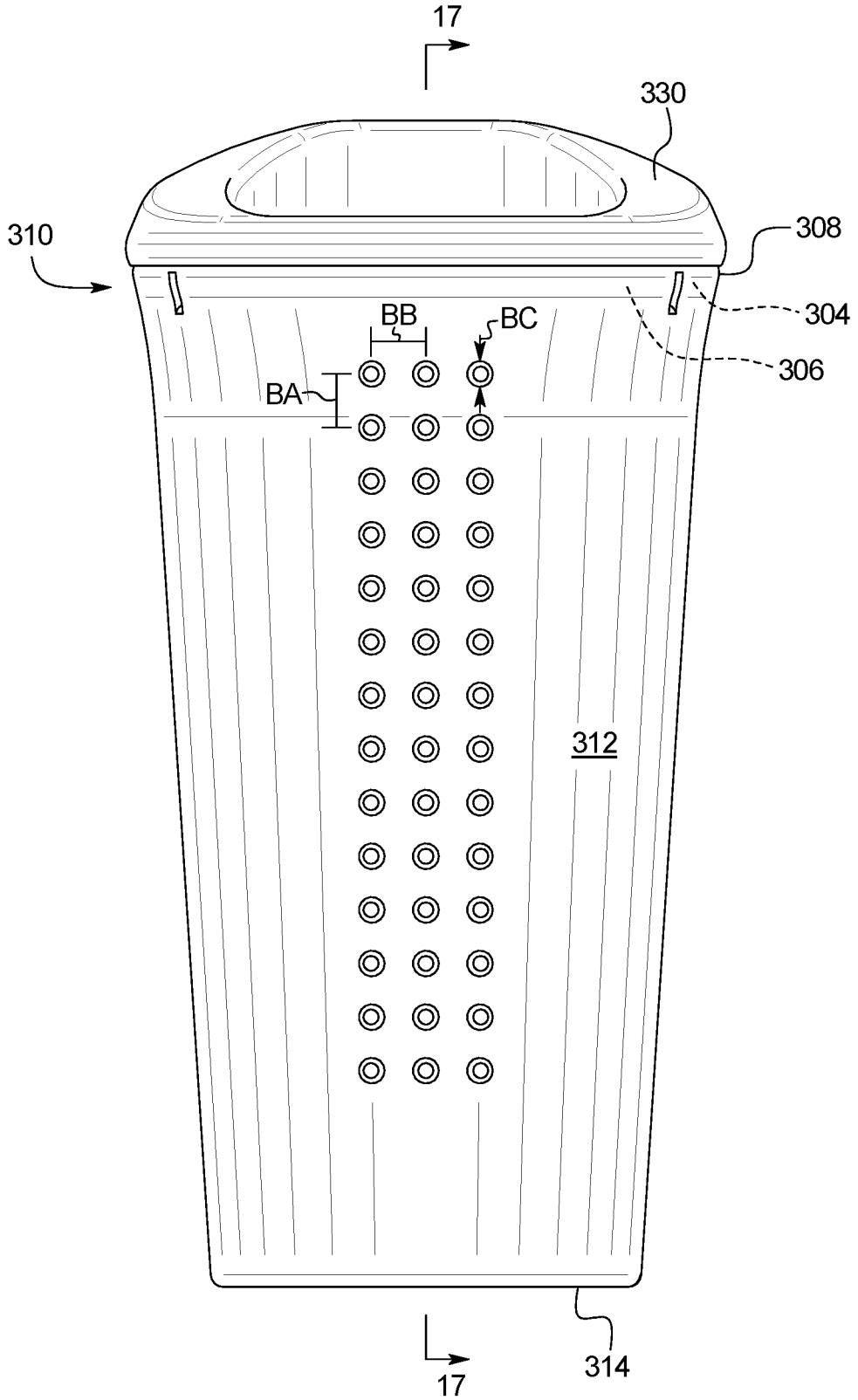
FIG. 16 is a side elevational view of the coffee cup and lid of FIG. 14.
Figure 17:
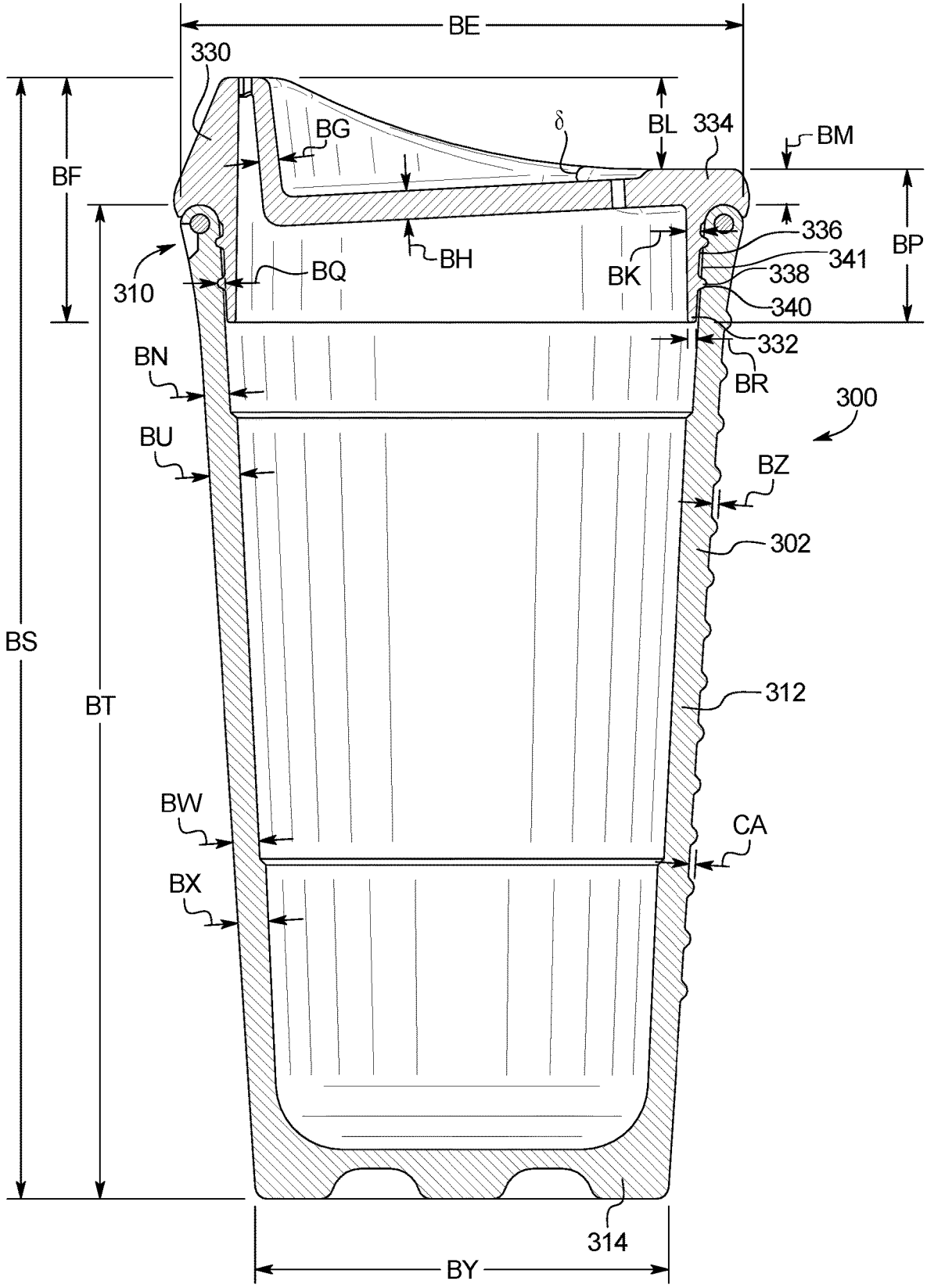
FIG. 17 is a cross sectional view of the coffee cup and lid taken generally along the lines 17-17 of FIG. 16, including exemplary dimensions.
Figure 18:
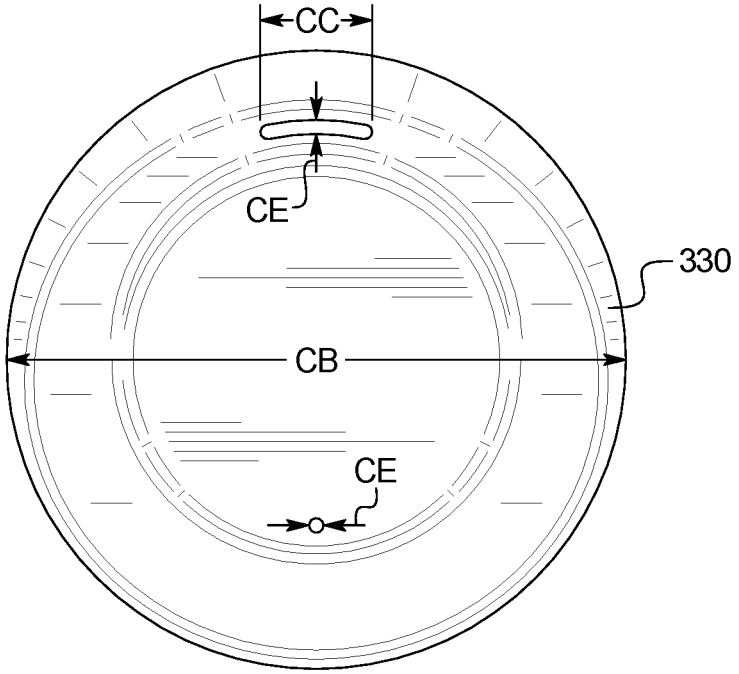
FIGS. 18 and 19 are plan and bottom plan views of the coffee cup and lid of FIG. 16.
Figure 19:
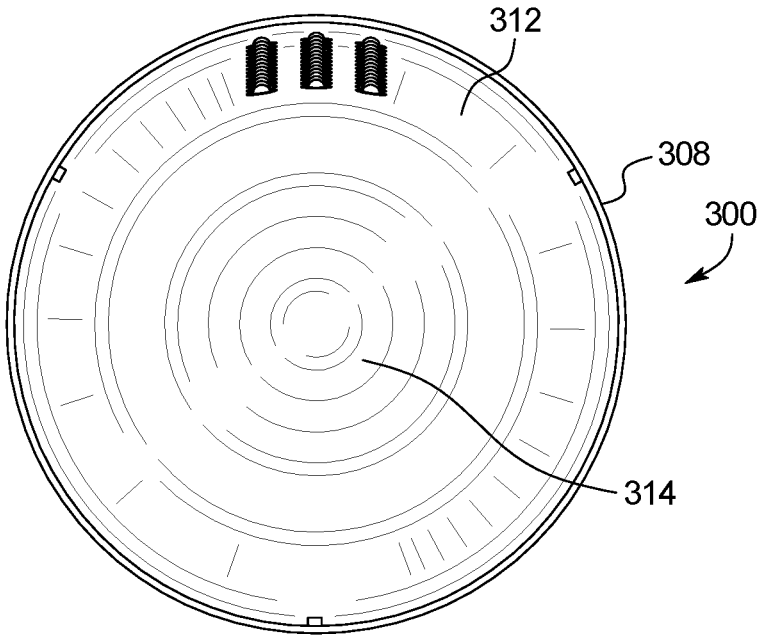
Figure 20:
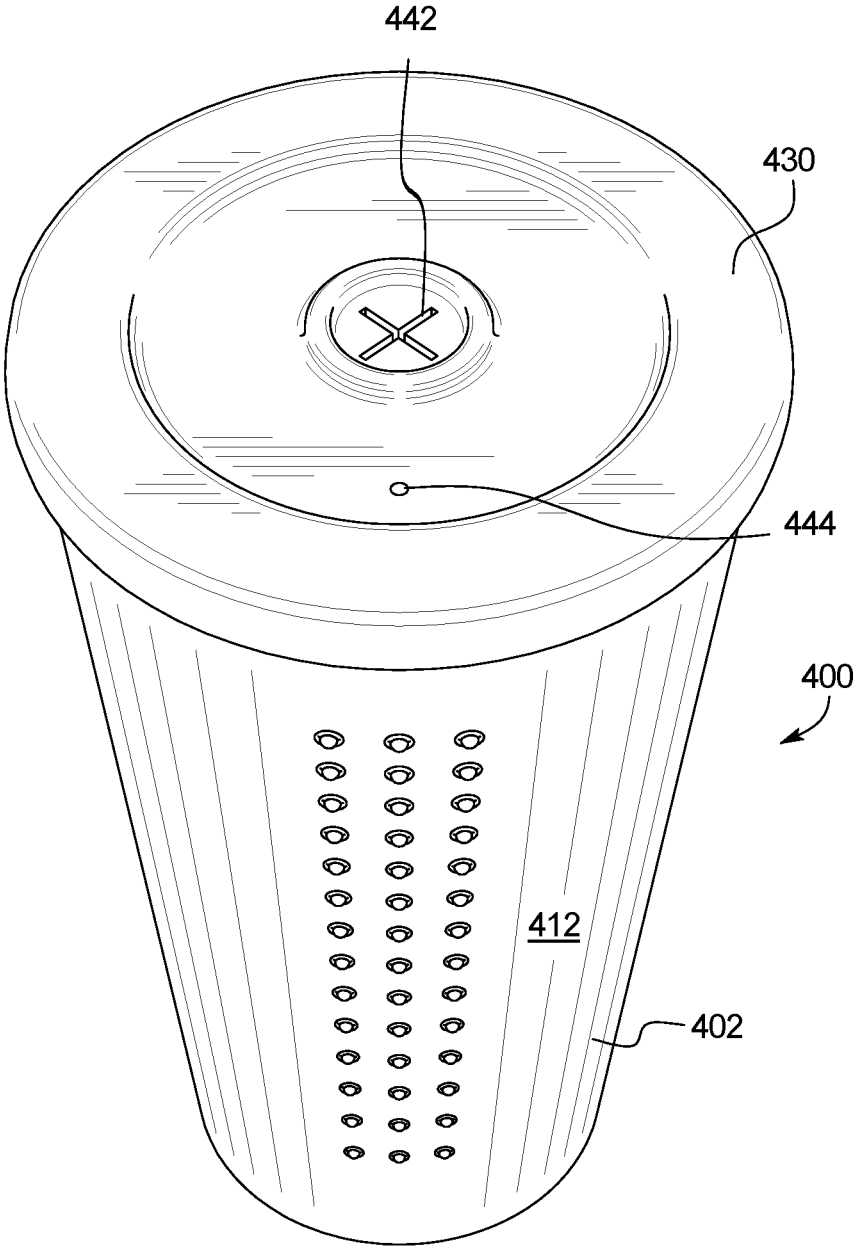
FIG. 20 is a perspective view of a further embodiment of a cup and lid in accordance with the present application.
Figure 21:
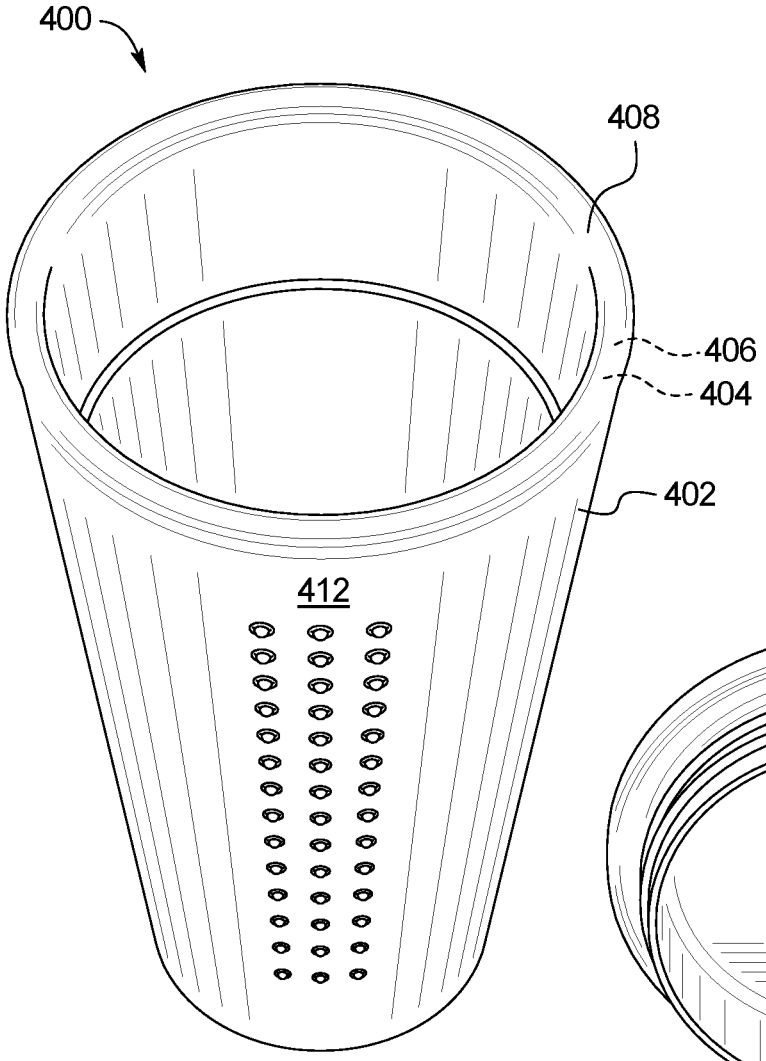
FIG. 21 is a perspective view of the cup of FIG. 20.
Figure 22:
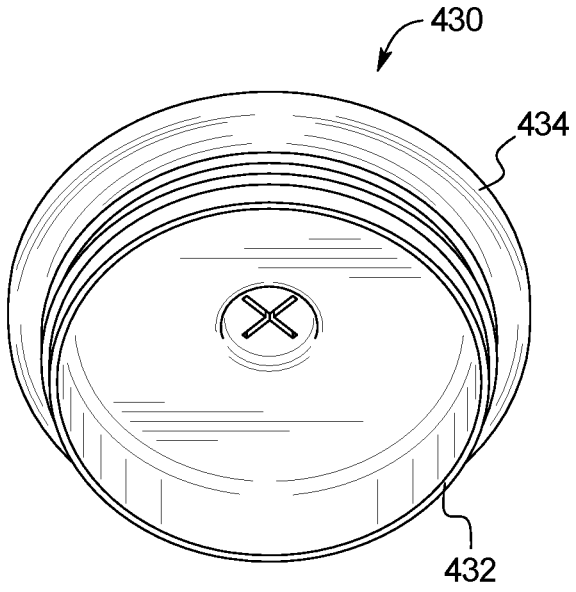
FIG. 22 is a perspective view from below of the lid of FIG. 20.
Figure 23:
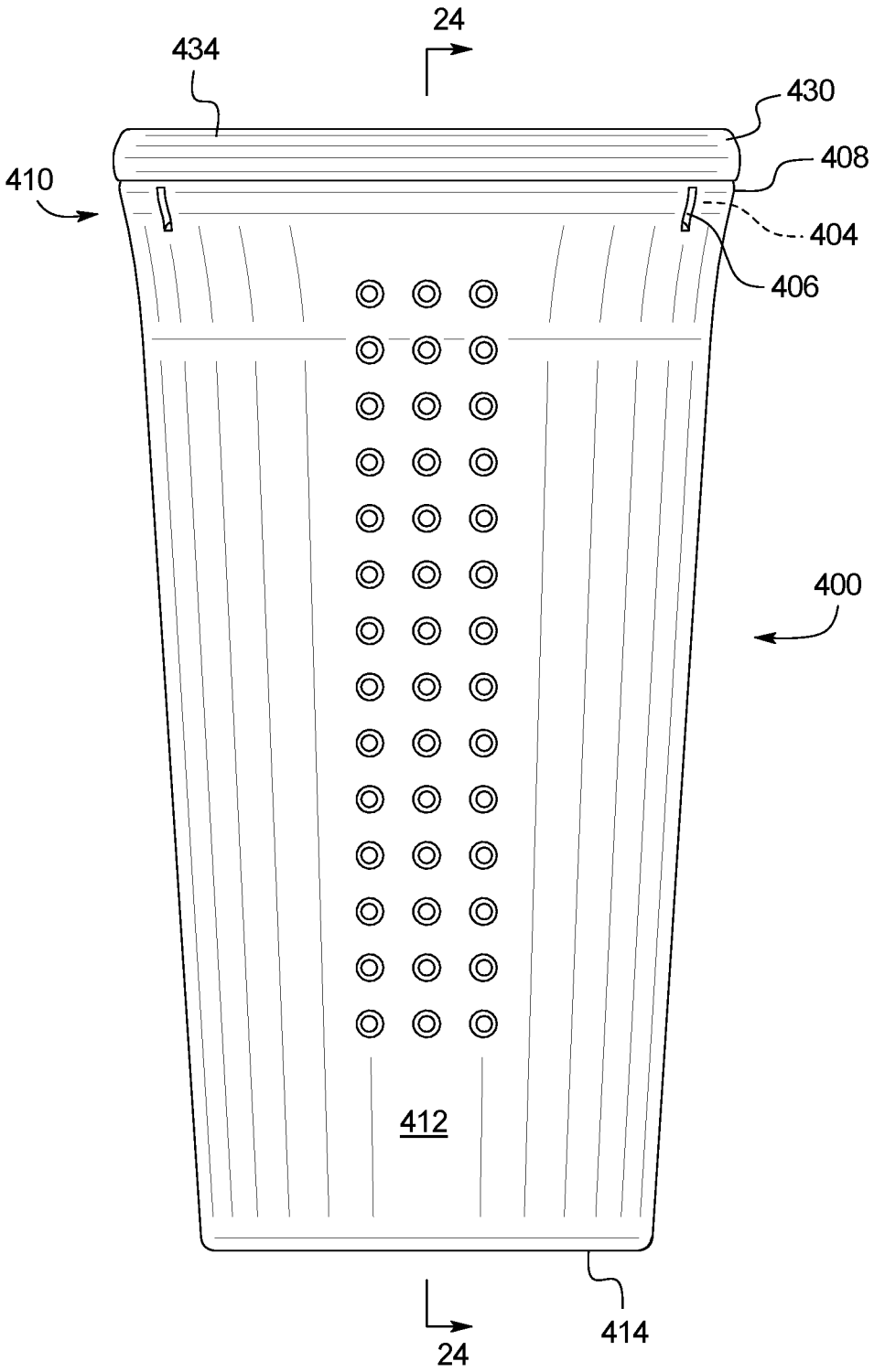
FIG. 23 is a side elevational view of the cup and lid of FIG. 20.

| Dimensions for FIGS. 16-18 | |
|---|---|
| | Dimensions (mm, unless otherwise specified) |
| FIG. 16 | |
| BA | 8.1 |
| BB | 8.1 |
| BC | 2.5 |
| BD | 118 |
| FIG. 17 | |
| BE | 87.2 |
| BF | 37.6 |
| BG | 3 |
| BH | 4.5 |
| δ | 3 degrees |
| BK | 2.2 |
| BL | 14.3 |
| BM | 5.4 |
| BN | 4 |
| BP | 23.3 |
| BQ | 1.5 |
| BR | 1.2 |

TABLE 3-continued

| Dimensions for FIGS. 16-18 | |
|---|---|
| | Dimensions (mm, unless otherwise specified) |
| BS | 173.7 |
| BT | 154 |
| BU | 5 |
| BW | 4 |
| BX | 5 |
| BY | 64 |
| BZ | 1 |
| CA | 1 |
| FIG. 18 | |
| CB | 89 |
| CC | 16 |
| CD | 2.1 |
| CE | 2 |

FIGS. 20-26 illustrates a further embodiment of a lid 430 for use with a cup 400. Similar to the previous embodiments, the cup 400 comprises a body 402 of a silicone material having an annular side wall 412 formed integrally with a base 414. A lipped rim 408 includes a metal ring 404 embedded within an internal channel 406 to provide structural support at an upper end 410 of the cup 400.

Similar to the lid 330 of FIGS. 14-19, the lid 430 may be press fit into the inner surface of the rim 408. Specifically, the lid 430 includes a top portion 434 with a downwardly extending annular wall 432. The annular wall 432 press fits inside the rim 408 so that the top portion 434 of the lid 430 rests atop the rim 408 of the cup 400. Seen best in FIG. 24, an outer surface 436 of the annular wall 432 includes one or more ribs 438 that are received by one or more grooves 440 within an inner surface 441 of the annular side wall 412. Referring back to FIG. 20, the top portion 434 also includes an opening 442 for receiving a straw and a port 444 for relieving pressure within the cup 300 during use. In the illustrated embodiment, the cup 400 can hold 16 oz, although the design can be scaled for greater or lesser volumes.

In the illustrated embodiment shown in FIGS. 20-26, the illustrated coffee cup has the dimensions recited in the following table, it being understood that the dimensions are exemplary only and do not limit the scope of any claims herein, except as may be recited thereby, together with equivalents thereof:

TABLE 4

Figure 24:
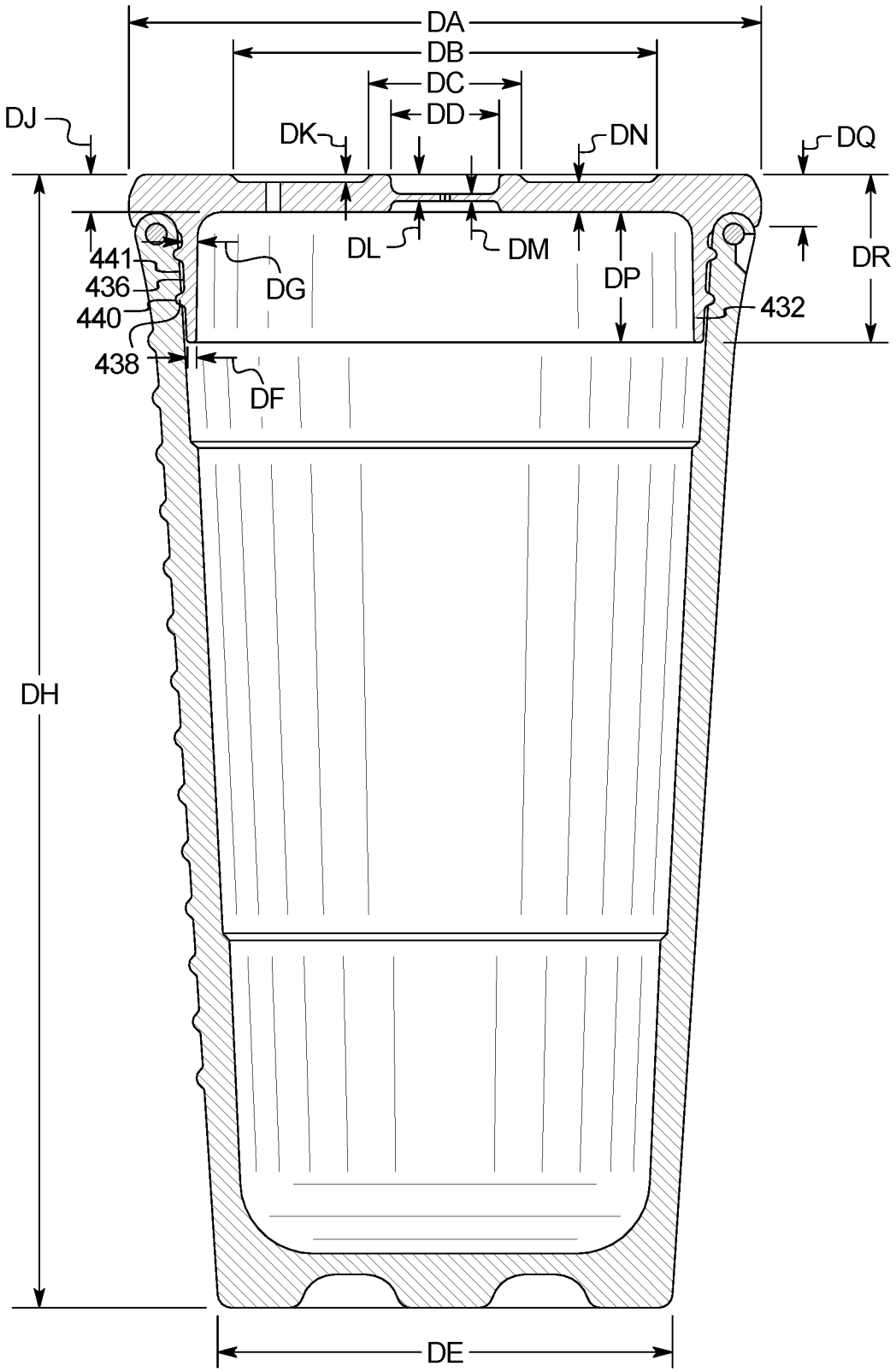
FIG. 24 is a cross sectional view of the cup and lid taken generally along the lines 24-24 of FIG. 23 including exemplary dimensions of the cup and lid.
Figure 25:
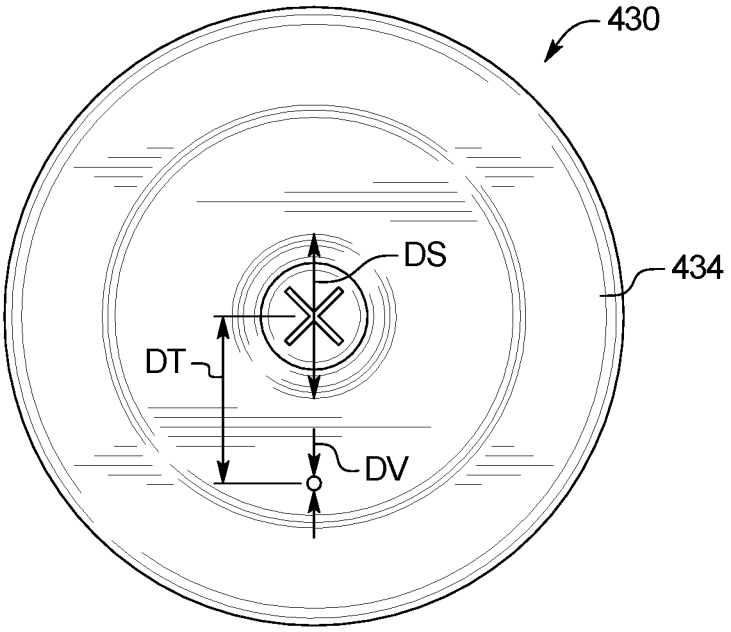
FIGS. 25 and 26 are plan and bottom plan view of the cup and lid of FIG. 20, including exemplary dimensions of the cup and lid.
Figure 26:
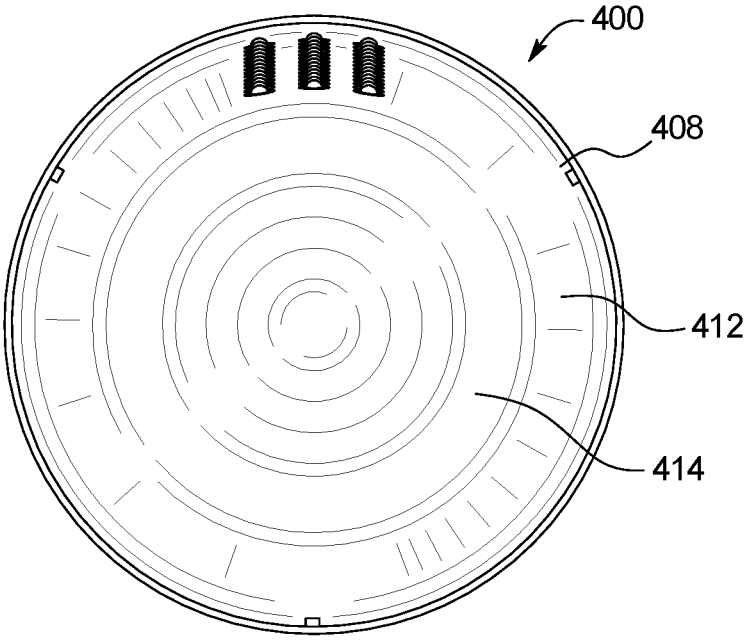

| Dimensions for FIGS. 24 and 25 | |
|---|---|
| | Dimensions (mm, unless otherwise specified) |
| FIG. 24 | |
| DA | 89 |
| DB | 59.3 |
| DC | 22 |
| DD | 15 |
| DE | 64 |
| DF | 1.2 |
| DG | 2.2 |
| DH | 159.5 |
| DJ | 5.5 |
| DK | 1 |
| DL | 2.7 |
| DM | 1 |

TABLE 4-continued

| Dimensions for FIGS. 24 and 25 | |
|---|---|
| | Dimensions (mm, unless otherwise specified) |
| DN | 4.5 |
| DP | 18.2 |
| DQ | 7.6 |
| DR | 23.6 |
| FIG. 25 | |
| DS | 22 |
| DT | 24 |
| DV | 2 |

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A container comprising:

a body formed from a flexible material, the body including an annular side wall formed integrally with a base;

an internal channel within the side wall; and a metal element disposed within the channel, wherein the annular side wall includes a rim located along a top of the side wall, wherein the internal channel is formed within the rim, wherein the rim includes a plurality of openings providing access to the metal element within the channel.

2. The container of claim 1, wherein the rim includes a lip extending outwardly from a centerline of the body.

3. The container of claim 2, wherein the base has a first thickness and the side wall has a second thickness, wherein the first thickness is greater than the second thickness.

4. The container of claim 3, wherein the lip includes a plurality of openings in communication with the channel.

5. The container of claim 1, wherein the metal element is segmented in a plurality of pieces.

6. The container of claim 1, wherein the metal element comprises a metal ring having a circular cross section.

7. The container of claim 6, wherein a diameter of the circular cross section is between about 2 mm and about 4 mm.

8. The container of claim 1, wherein the flexible material comprises silicone.

9. The container of claim 1, further comprising a lid mated with the body.

10. The container of claim 9, wherein the lid comprises a flexible surface that surrounds an upper portion of the body.

11. The container of claim 9, wherein the lid press fits into a rim located along a top of the annular side wall.

12. The container of claim 1, wherein the container comprises one of a cup and a bowl.

13. The container of claim 1, wherein the container is a cup.

14. The container of claim 1, wherein the container is a bowl.

15. The container of claim 1, wherein the metal element is a metal ring encapsulated within the channel of the rim.

16. The container of claim 1, wherein the metal element is a metal ring, wherein the metal ring can be inserted into the channel of the rim through the plurality of openings.

17. The container of claim 1, wherein the side wall includes a plurality of protrusions extending outwardly from an outer surface of the side wall.

* * * * *